US009502807B2

(12) United States Patent
Mortun et al.

(10) Patent No.: US 9,502,807 B2
(45) Date of Patent: Nov. 22, 2016

(54) TAMPER RESISTANT RECEPTACLE

(71) Applicant: Hubbell Incorporated, Shelton, CT (US)

(72) Inventors: Sorin Mortun, Irvington, NY (US); Athanasios Diakomis, Shelton, CT (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/743,540

(22) Filed: Jun. 18, 2015

(65) Prior Publication Data

US 2015/0380856 A1 Dec. 31, 2015

Related U.S. Application Data

(60) Provisional application No. 62/015,131, filed on Jun. 20, 2014.

(51) Int. Cl.
*H01R 13/453* (2006.01)

(52) U.S. Cl.
CPC ..... *H01R 13/4534* (2013.01)

(58) Field of Classification Search
CPC ..... H01R 13/447; H01R 13/453; H01R 13/4532; H01R 13/4534; H01R 13/4536; H01R 13/4538
USPC ..... 439/137–140
See application file for complete search history.

(56) References Cited

U.S. PATENT DOCUMENTS 4,379,607 A * 4/1983 Bowden, Jr. ..... H01R 13/4534 439/137
4,544,219 A * 10/1985 Barkas ..... H01R 13/4534 439/137
4,822,290 A * 4/1989 Cauley ..... H01R 13/4534 439/137
4,867,694 A * 9/1989 Short ..... H01R 13/4534 439/137
5,006,075 A * 4/1991 Bowden, Jr. ..... H01R 13/4534 439/137
5,020,997 A * 6/1991 Calderara ..... H01R 13/4534 439/137
5,915,981 A * 6/1999 Mehta ..... H01R 13/4534 439/137
6,056,564 A * 5/2000 Huang ..... H01R 13/4534 439/137
6,086,391 A * 7/2000 Chiu ..... H01R 13/4534 439/145
6,217,353 B1 * 4/2001 Yu-Tse ..... H01R 13/4534 174/67
6,238,224 B1 * 5/2001 Shao ..... H01R 13/4534 439/137
6,422,880 B1 * 7/2002 Chiu ..... H01R 13/4534 439/137
6,537,088 B2 * 3/2003 Huang ..... H01R 13/4534 439/137
6,537,089 B1 * 3/2003 Montague ..... H01R 13/4534 439/137
6,555,771 B2 * 4/2003 Shao ..... H01R 13/4534 200/51 R
6,776,630 B1 * 8/2004 Huang ..... H01R 13/4534 439/137

(Continued)

*Primary Examiner* — Ross Gushi
(74) *Attorney, Agent, or Firm* — Michael Best & Friedrich, LLP

(57) ABSTRACT

A tamper resistant electrical receptacle comprising a slide housing disposed beneath the hot and neutral blade openings in the receptacle. The slide housing includes a neutral slide body and a hot slide body having slide pads and tabs for reducing friction when the bodies slide against each other as the spring bias of the bodies in the slide housing is overcome by simultaneous insertion of the tines of an electrical plug contact ramp surfaces and camming past the slide bodies causing them to slide against each other and spreading a gap area a distance sufficient for receiving the lateral neutral prong of a 20 A electrical plug.

14 Claims, 8 Drawing Sheets

(56) References Cited

U.S. PATENT DOCUMENTS 6,786,745 B1 * 9/2004 Huang ..... H01R 13/4534 439/137
6,893,275 B2 * 5/2005 Ng ..... H01R 13/4534 439/137
7,179,992 B1 * 2/2007 Packard ..... H01R 13/4536 174/53
7,455,538 B2 * 11/2008 Germain ..... H01R 13/4534 439/137
7,510,412 B1 * 3/2009 Valentin ..... H01R 13/4534 439/137
7,556,513 B2 * 7/2009 Ng ..... H01R 13/4534 439/137
7,588,447 B1 * 9/2009 Ni ..... H01R 13/4534 439/137
7,637,756 B1 * 12/2009 Hsu ..... H01R 13/4534 439/137
7,645,148 B2 * 1/2010 Carbone ..... H01R 13/4534 439/137
7,645,149 B2 * 1/2010 Carbone ..... H01R 13/4534 439/137
7,651,347 B2 * 1/2010 Germain ..... H01R 13/4534 439/137
7,651,348 B2 * 1/2010 Huang ..... H01R 13/4534 439/137
7,695,293 B1 * 4/2010 Sikes ..... H01R 13/4532 439/139
7,820,909 B2 * 10/2010 Castaldo ..... H01R 13/4534 174/53
7,833,030 B1 * 11/2010 Huang ..... H01R 13/4534 439/137
7,859,368 B2 * 12/2010 Huang ..... H01H 83/04 335/18
7,883,346 B2 * 2/2011 Huang ..... H01R 13/4534 439/140
7,887,346 B1 * 2/2011 Huang ..... H01R 13/4534 439/140
7,914,307 B1 * 3/2011 Yang ..... H01R 13/4534 439/137
7,934,935 B1 * 5/2011 Gao ..... H01R 13/4534 439/137
7,938,676 B1 * 5/2011 Patel ..... H01Q 1/2233 439/137
7,942,681 B2 * 5/2011 Ni ..... H01R 13/4534 439/137
7,985,085 B2 * 7/2011 Gao ..... H01R 13/4534 439/137
8,007,296 B2 * 8/2011 Chen ..... H01R 13/4534 439/136
8,044,299 B2 * 10/2011 Weeks ..... H01R 13/4534 174/53
8,100,705 B2 * 1/2012 Chen ..... H01R 13/4534 439/137
8,147,260 B2 * 4/2012 Huang ..... H01R 13/4534 439/140
8,187,011 B1 * 5/2012 Baldwin ..... H01R 13/4534 439/137
8,187,012 B1 * 5/2012 Baldwin ..... H01R 13/4534 439/137
8,193,445 B2 * 6/2012 Li ..... H01R 13/4534 174/50
8,242,362 B2 * 8/2012 Castaldo ..... H01R 13/4534 174/53
8,297,990 B2 * 10/2012 Huang ..... H02H 3/16 439/140
8,366,463 B2 * 2/2013 Zhang ..... H01R 13/4534 439/135
8,382,497 B2 * 2/2013 Huang ..... H01R 13/4534 439/137
8,491,319 B1 * 7/2013 Baldwin ..... H01R 13/4534 439/137
8,550,829 B2 * 10/2013 Huang ..... H01R 13/4534 439/127
8,562,362 B2 * 10/2013 Jiang ..... H01R 13/4534 439/137
8,568,152 B1 * 10/2013 Weeks ..... H05K 5/02 439/137
8,632,347 B2 * 1/2014 Chen ..... H01R 13/453 439/137
8,632,348 B2 * 1/2014 Baldwin ..... H01R 13/4534 439/138
8,672,695 B2 * 3/2014 Baldwin ..... H01R 13/4534 439/137
8,808,013 B2 * 8/2014 Baldwin ..... H01R 13/4534 439/139
8,834,186 B2 * 9/2014 Lo ..... H01R 13/4534 439/140
8,858,245 B2 * 10/2014 Huang ..... H01R 13/4534 439/137
8,888,514 B2 * 11/2014 Baldwin ..... H01R 13/4534 439/137
9,048,559 B2 * 6/2015 Huang ..... H01R 13/4534
9,059,529 B1 * 6/2015 Lai ..... H01R 13/44
9,059,530 B2 * 6/2015 Byrne ..... H01R 13/4534
9,196,995 B2 * 11/2015 Scanzillo ..... H01R 13/453
2009/0186500 A1 * 7/2009 Benoit ..... H01R 13/4534 439/93
2009/0311892 A1 * 12/2009 Weeks ..... H01R 13/4534 439/137
2010/0041259 A1 * 2/2010 Ni ..... H01R 13/4534 439/137
2010/0159722 A1 * 6/2010 Chen ..... H01R 13/4534 439/137
2011/0136358 A1 * 6/2011 Zhang ..... H01R 13/4534 439/135
2011/0263145 A1 * 10/2011 Kim ..... H01R 13/4534 439/137
2012/0083143 A1 * 4/2012 Jiang ..... H01R 13/4534 439/137
2012/0149221 A1 * 6/2012 Huang ..... H01R 13/4534 439/137
2013/0295788 A1 * 11/2013 Baldwin ..... H01R 13/4534 439/137
2014/0030898 A1 * 1/2014 Baldwin ..... H01R 13/4534 439/140
2015/0064944 A1 * 3/2015 Scanzillo ..... H01R 13/4534 439/137
2015/0372411 A1 * 12/2015 Ewer ..... H01R 13/4534 439/138
2015/0380856 A1 * 12/2015 Mortun ..... H01R 13/4534 439/138
2016/0013577 A1 * 1/2016 Diakomis ..... H01R 13/4536 439/138

* cited by examiner

SECTION B-B

TAMPER RESISTANT RECEPTACLE

CROSS-REFERENCE TO RELATED APPLICATIONS

The present application claims the benefit of priority under 35 U.S.C. 102(e) from U.S. Provisional Application 62/015,131, filed Jun. 20, 2014, the contents of which are hereby incorporated by reference in their entirety.

FIELD OF THE INVENTION

The present invention relates to tamper resistant electrical receptacles. More particularly, the present invention relates to tamper resistant electrical receptacles using laterally sliding shutters spring biased to block access to the device's electrical contacts.

BACKGROUND OF THE INVENTION

Tamper resistant receptacles are known in the art. "Tamper Resistant" or "TR" receptacles are a class of electrical receptacle outlets configured to deny access to the device's electrical contacts unless force is applied simultaneously to both the hot and neutral plug openings of the device pursuant to NEC Code 406.11 et seq. The Code and related regulatory requirements provide that not only must the outlet openings remain blocked unless force is applied to both openings at the same time, but also that any foreign object 1/32 inch or larger, must be prevented from bypassing the blocking member of a plug opening.

As will be appreciated, these requirements were enacted in response to the phenomena of small children curiously inserting a small toy or metal object into the hot or neutral opening of a receptacle and suffering electrical shock, burns, or even death.

In meeting the standard and providing the level of protection sought from these devices, the art has gravitated towards a configuration of receptacles utilizing cooperating shutter members to block access beyond the faceplate openings of the outlet. Specifically, to ensure that force directed into only one of the two blade openings is prevented from reaching the electrical contact that lies beneath, a sliding shutter mechanism is spring-biased into a position blocking (or "shuttering") the blade opening from underneath the faceplate. The shutter physically prevents an object entering the blade opening from reaching the electrical contact below that shutter. In order to allow the shutter of a respective blade opening to be uncovered, the spring-bias must be overcome by a camming action caused by the other plug blade during insertion in the other blade opening.

To this end, the most common prior art configuration of a TR receptacle includes a shutter assembly comprising a pair of cooperating shutters. Each of the shutters includes a blocking portion positioned below a respective one of the blade openings blocking access to the contacts. Each of the shutters also includes a cam portion that extends to the opposite blade opening that receives contact from a plug blade and translates the vertical force of a plug blade and camming action into a lateral sliding displacement of the blocking portion. Thus, force by vertical insertion of a plug-blade on the neutral blade opening will move the shutter from obstructing access to the electrical contact below the hot blade opening, and vice versa. Specifically, for example, during insertion of a plug, the neutral blade tine will cam against and past the shutter cam surface forcing the shutter cam arm to move laterally, thereby overcoming the spring bias of the shutter and causing the hot blade shutter blocking portion to slide into a position away from and revealing the electrical contact beneath the hot blade opening. Likewise, force on the hot blade opening will contact the cam surface and allow the blade to cam past and move the arm and compress the spring to move the shutter blocking portion that covers the neutral blade opening out of the way. As will be appreciated, with this configuration, when a child tries to insert a toy into either opening of the outlet, the blocking portion of the shutter remains immobile from the spring bias of the opposite shutter and prevents the child from reaching the electrical contact. However, when both blades of an electrical plug contact the shutters simultaneously, the simultaneous force and camming action allows both blades to continue their downward insertion by simultaneously sliding respective shutter blocking portions laterally out of the way of the electrical contacts of the opposite shutter until the blades cam past the shutters and are able to properly "plug in" to the outlet's internal face contacts.

Existing prior art TR receptacle designs and their operational details are available in U.S. Pat. No. 4,379,607 to Bowden, Jr.; U.S. Pat. No. 7,645,148 to Carbone et al.; and U.S. Publ. No. 2013/0295788 to Baldwin, et al. and the references cited therein, the entire contents of which are hereby incorporated by reference in their entirety.

The proliferation of these important safety devices has led to an appreciation of the issues affecting their effective life span. A presently appreciated issue recognized by the present inventors stems from the translation of the vertical force of the plug blade into lateral movement of the shutters. With cooperating shutter assemblies, the shutters of each blade opening are frictionally forced to slide against each other in opposite directions. Additionally, the shutters are seated in a housing and frictionally side within the housing. Typically, the shutters and housing are generally planar and are in frictional contact along a substantial portion of their bodies. Sliding two or more materials against each other results in increased force needed to compensate for the frictional forces attendant to the areas of contact. The greater the contact area, the greater the frictional force to be overcome to cause the desired movement.

Another presently appreciated issue recognized by the present inventors stems from the sharpness of plug blades being found on electrical products imported from overseas. As will be appreciated, during insertion of the plug blades into the outlet face openings, the vertical force of the incoming blades has the same point of contact on the cam surface. The cam surface of most prior art devices is an inclined "ramp" of about 45O that is of a length sufficient to cause lateral displacement during insertion of a distance that is equal to the entire distance necessary to un-shutter a blade opening (typically about 1.8 mm). Over time, these sharp blades having a single point of initial contact begin to deform and cut into the ramp surface which makes movement more difficult as the blades get stuck in divets or scratches at the point of contact. With each successive insertion, more and more force is needed to friction force the camming action and concomitant lateral sliding of the shutters. At some point, the deformity of the ramp surface may make insertion of a plug excessively difficult or even impossible. At this point, the device has reached the end of its useful life.

When considered in combination, the large area of contact between the surfaces of the constituent components and the increasing force necessitated by deforming ramps equates to larger amounts of force being required to get these types of TR receptacles into the open and operational position. This, in turn, may be rationally extrapolated to mean a shorter useful life of the product unless mitigated.

Yet another presently appreciated issue recognized by the present inventors is that many convention TR receptacle designs cannot accommodate deployment in a 20 A receptacle due to the inability to provide sufficient clearance for the perpendicularly oriented neutral blade of the plug.

The foregoing underscores some of the problems associated with conventional TR receptacles. Furthermore, the foregoing highlights the long-felt, yet unresolved need in the art for a TR receptacle that may extend the useful life of the device. Moreover, the forgoing highlights the long-felt, yet unresolved need in the art for a TR receptacle that has an extended service life at a reasonable cost. Finally, the foregoing highlights the long-felt need for an improved TR receptacle configuration that is useful in 15 A and 20 A receptacles.

SUMMARY OF THE INVENTION

Various embodiments of the present invention overcome various of the aforementioned and other disadvantages associated with prior art TR receptacles and offers new advantages as well. Although not wishing to be bound by theory, the present inventors' recognize that limiting the areas of contact between the sliding shutter members and/or the shutter housing results in a more frictionally advantageous configuration that may extend the service life of some prior art TR receptacles.

According to one aspect of various embodiments of the present invention there is provided a TR receptacle having cooperating shutter mechanisms wherein the shutters are configured to minimize the points of contact between the two to reduce the frictional forces during lateral movement.

According to another aspect of various embodiments of the present invention, there is provided a TR receptacle having cooperating shutter mechanisms wherein the ramp area of each shutter includes a metal skin to resist gauging and deforming by plug blades.

According to another aspect of various embodiments of the present invention there is provided a TR receptacle configured for use in a 20 A receptacle. According to this aspect of the invention, in a presently preferred embodiment the receptacle includes a shutter assembly having a hot shutter member and a neutral shutter member comprising flexible arms for accommodating the perpendicular blade of a 20 A plug.

The invention as described and claimed herein should become evident to a person of ordinary skill in the art given the following enabling description and drawings. The aspects and features of the invention believed to be novel and other elements characteristic of the invention are set forth with particularity in the appended claims. The drawings are for illustration purposes only and are not drawn to scale unless otherwise indicated. The drawings are not intended to limit the scope of the invention. The following enabling disclosure is directed to one of ordinary skill in the art and presupposes that those aspects of the invention within the ability of the ordinarily skilled artisan are understood and appreciated.

BRIEF DESCRIPTION OF THE DRAWINGS

Various aspects and advantageous features of the present invention will become more apparent to those of ordinary skill when described in the detailed description of preferred embodiments and reference to the accompany drawing wherein.

DETAILED DESCRIPTION OF A PREFERRED EMBODIMENT

Figure 1:
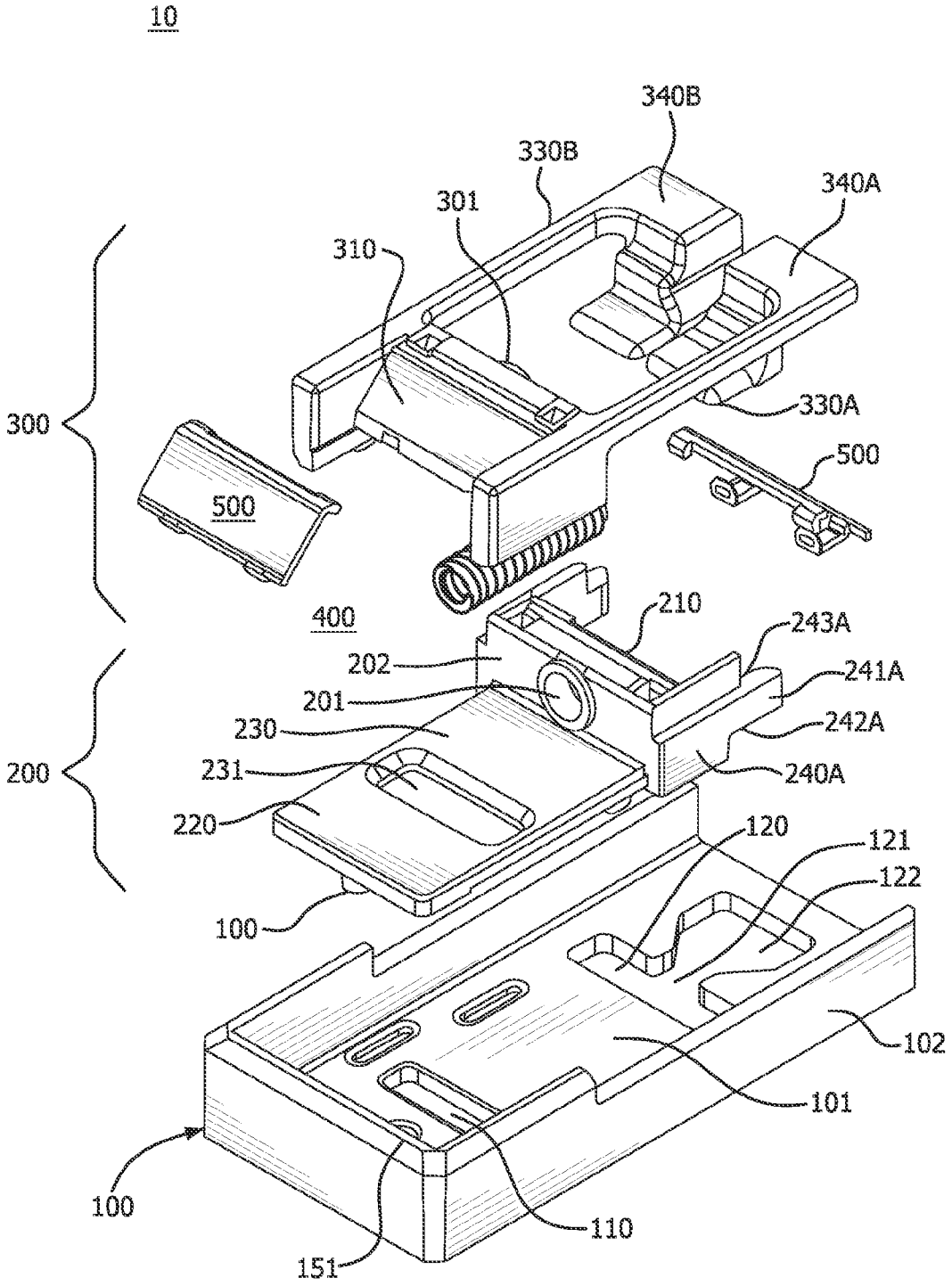
FIG. 1 is a top exploded view of a shutter assembly of a TR receptacle according to an exemplary embodiment of the invention.
Figure 2:
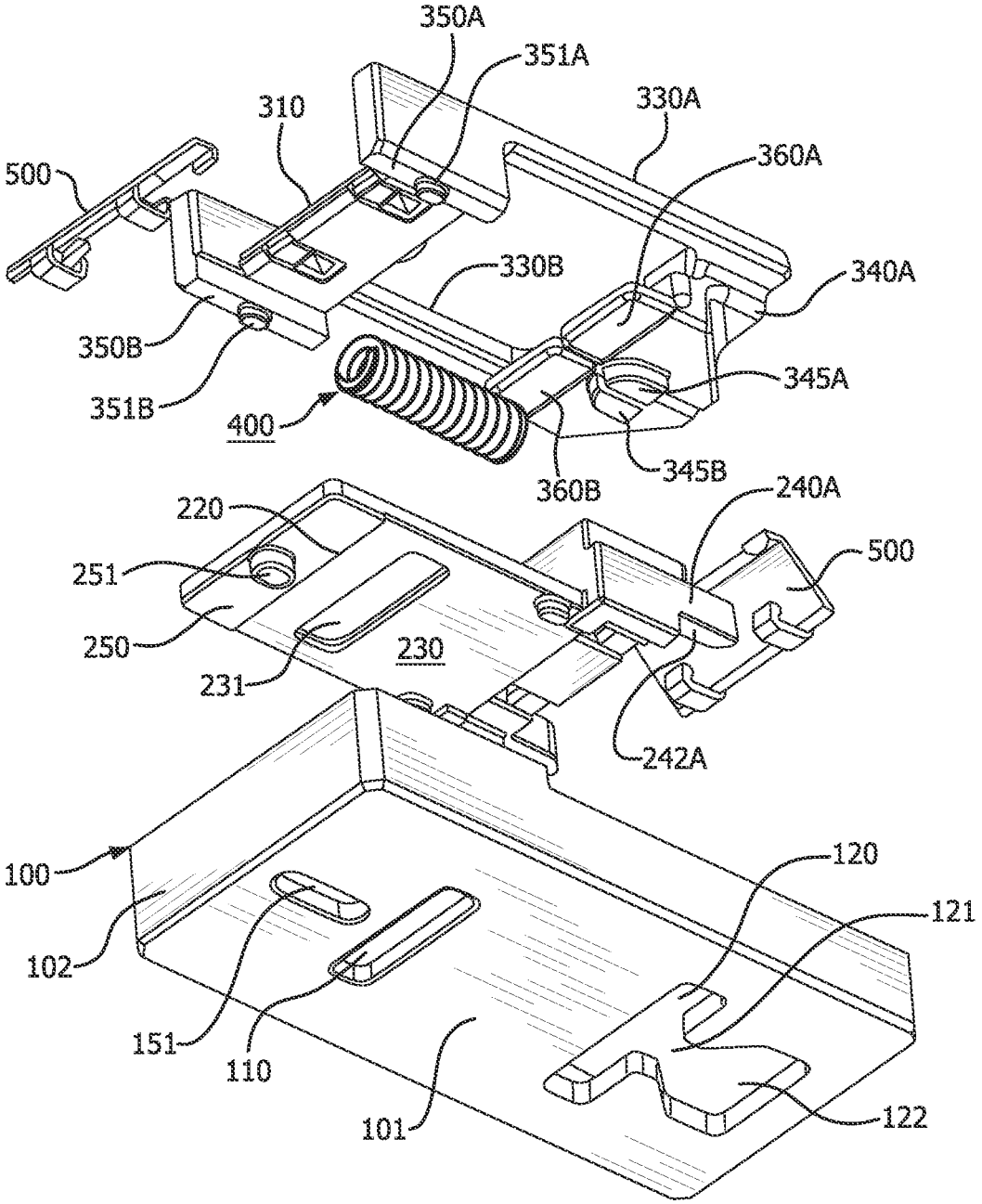
FIG. 2 is a bottom exploded view of the shutter assembly of FIG. 1.
Figure 3:
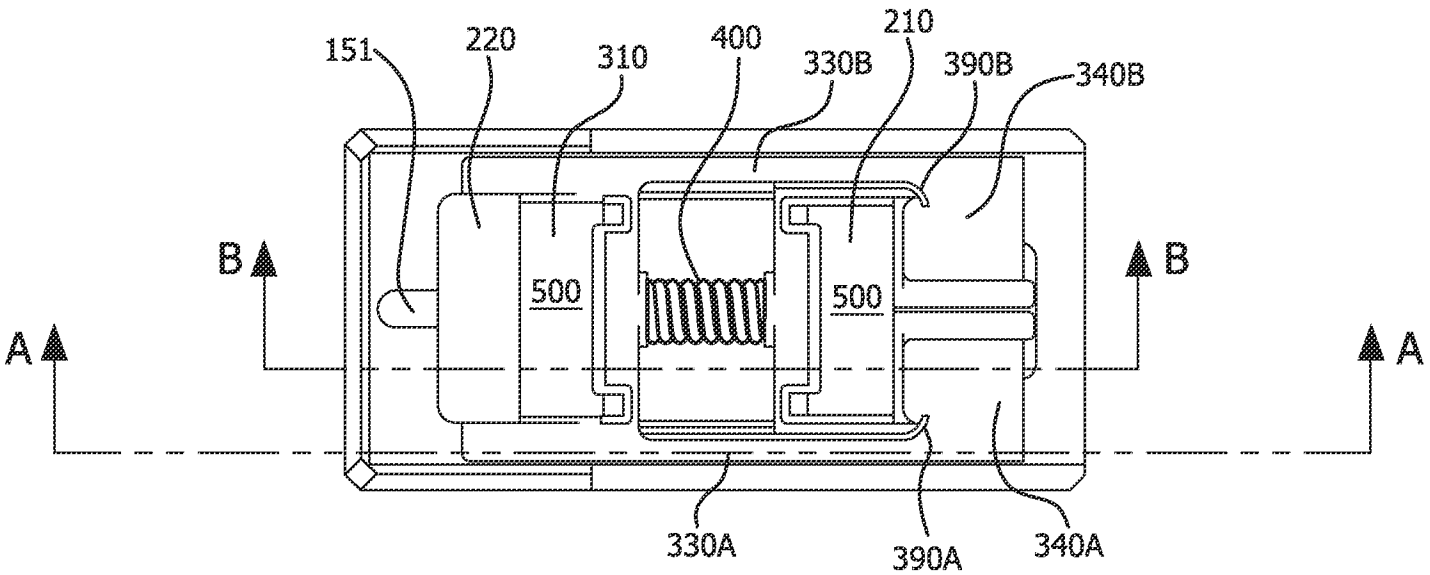
FIG. 3 is a top view of the shutter assembly of FIG. 1.
Figure 4:
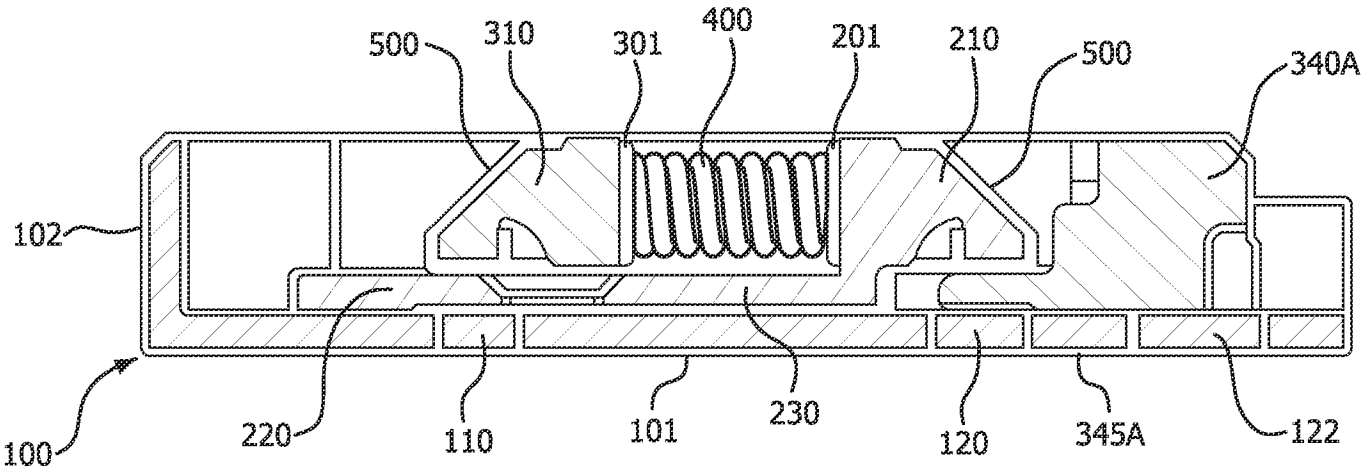
FIG. 4 is a cross-sectional view of the shutter assembly of FIG. 1.

While the present invention will be described in connection with a TR receptacle of the type having cooperating shutters generally described above, it will be readily apparent to one of ordinary skill in the art armed with the present specification that the present invention can be applied to a multiplicity of fields and uses. In particular, the present invention may find use in connection with other types of TR receptacles where reduction in frictional contact between surfaces is desirable. One of ordinary skill in the art armed with the present specification will also understand that the present system may be easily modified to include different configurations, mechanisms, methods, and kits, which achieve some or all of the purposes of the present invention.

As will be discussed in more detail below, the basic concept described in an illustrative embodiment according to the present invention is that the hot slider does not make contact with the neutral slider. Rather, each slider slides along its own tracks in the slider housing. Specifically, the hot slider includes slide pads and slide tabs adapted to slide in tracks in an inside surface of the slider housing, and the neutral slider includes slide pads and tabs adapted to slide in other tracks in the inside surface of the slider housing. With this embodiment, friction is reduced during the plugging process, when compared to a prior art embodiment in which the hot slider makes contact with the neutral slider, because there is no interface between the hot slider and the neutral slider. Specifically, there is no frictional force on the hot slider due to an interface between the hot slider and the neutral slider, and no frictional force on the neutral slider due to an interface between the hot slider and the neutral slider. Although not sliding against each other, the sliders still cooperate in a manner that only allows the electrical contacts of an electrical receptacle to be accessed if simultaneous force is applied to both the hot and neutral plug openings. If force is only applied to one of the openings, the electrical contacts cannot be reached.

Turning to the exemplary embodiment depicted in the Figures, the slider assembly 10 includes a slider housing 100; a neutral blade slide body, or "neutral slider" 200; a hot blade slide body, or "hot slider" 300; and a central spring 400. In operation, as with the prior art devices described above, the blades of an electrical plug cause lateral movement of the sliders 200, 300 by overcoming the bias of the central spring 400. However, in the embodiment depicted, the sliders and housing are configured to reduce the frictional forces of the assembly as compared to prior art devices. Additionally, the component parts are adapted for use with a 20 A receptacle.

To these ends, the slider housing 100 is configured as a unitary piece of plastic sized and shaped to fit within the footprint of an electrical receptacle. The housing 100 is generally tub shaped having a central planar portion 101 surrounded by an ascending perimetrical sidewall 102 of a height sufficient to house the assembly's operative components and rest flush with the faceplate of an electrical outlet (not shown).

The central planar portion 101 of the slider housing includes a hot plug blade opening 110 and a neutral plug blade opening 120. The neutral plug blade opening 120 is not only longer than the hot blade opening 110 for receiving the larger neutral blade of a plug, but also wider to accommodate the perpendicularly oriented neutral blade of a 20 A plug. Additionally, the neutral plug blade opening 120 includes a lateral neck portion 121 and a pentagonal head portion 122. As will be described in more detail below, this configuration serves as part of the safety features of the device.

The neutral slider 200 and hot slider 300 are disposed in the slider housing 100. In the depicted embodiment, the sliders 200, 300 are spring biased in the "closed" position by a centrally disposed helical spring 400 that extends between spring seats 201, 301 disposed on opposing lateral faces 202, 302 of the sliders 200, 300. The lateral faces 202, 302 are on the centrally facing side opposite each of the respective ramp portions 210, 310 of the sliders 200, 300. The ramp portions 210, 310 are the portions of the sliders 200, 300 that lie beneath the blade openings in the receptacle faceplate and receive the blades during the initial stages of plug insertion. As depicted, the neutral slider 200 has a ramp 210 that is contacted by the neutral blade of an electrical plug, and the hot slider 300 has a ramp 310 that is contacted by the hot blade of an electrical plug. The names of the sliders were chosen arbitrarily based on the blade of the electrical plug that contacts them. Thus, for clarity in understanding the discussion that follows, it is the neutral slider that includes a portion that blocks access to the hot electrical contact and the hot slider that includes a portion that blocks access to the neutral electrical contact.

Figure 5:
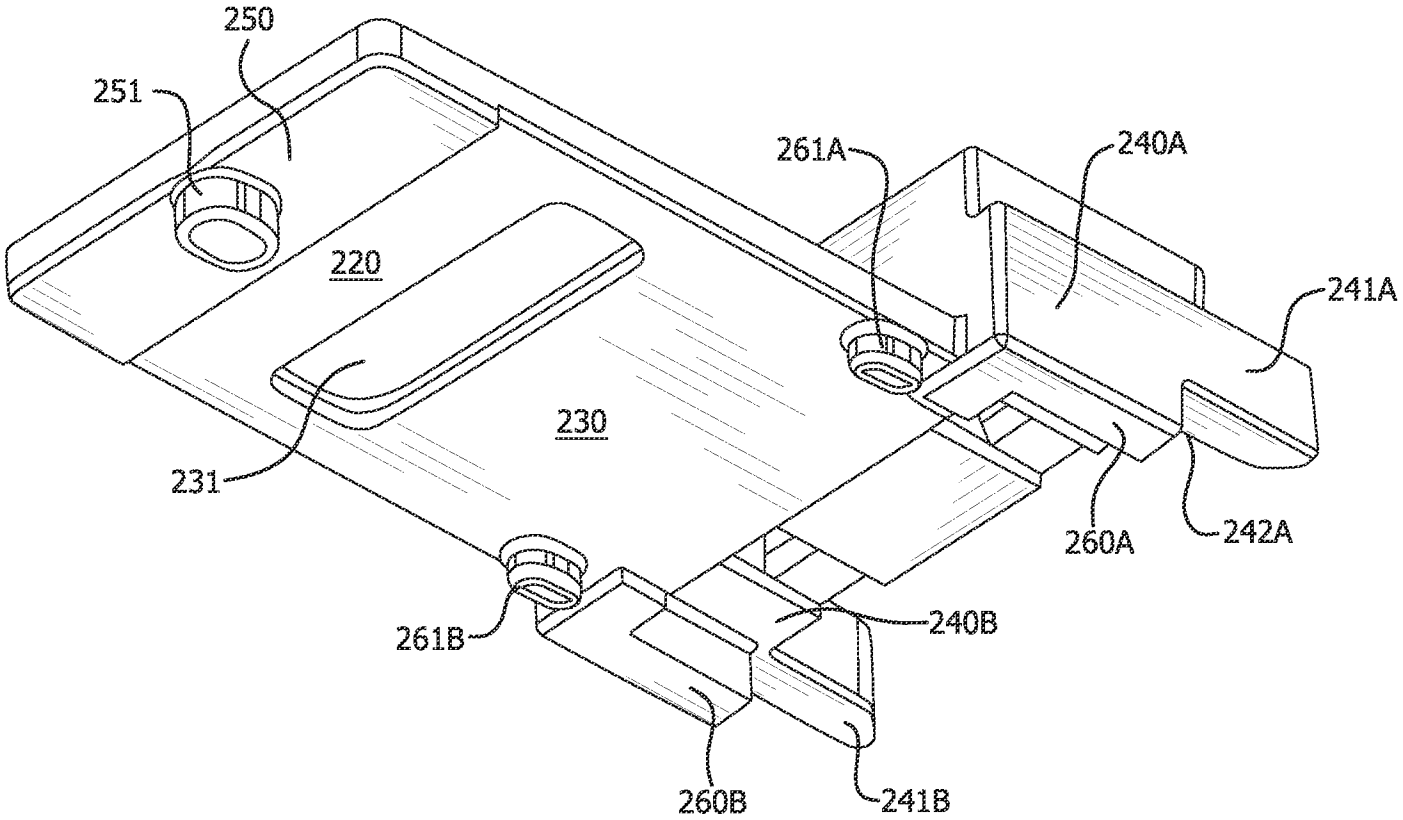
FIG. 5 is a bottom left perspective view of the neutral shutter of an exemplary embodiment of a TR receptacle according to the invention.
Figure 6:
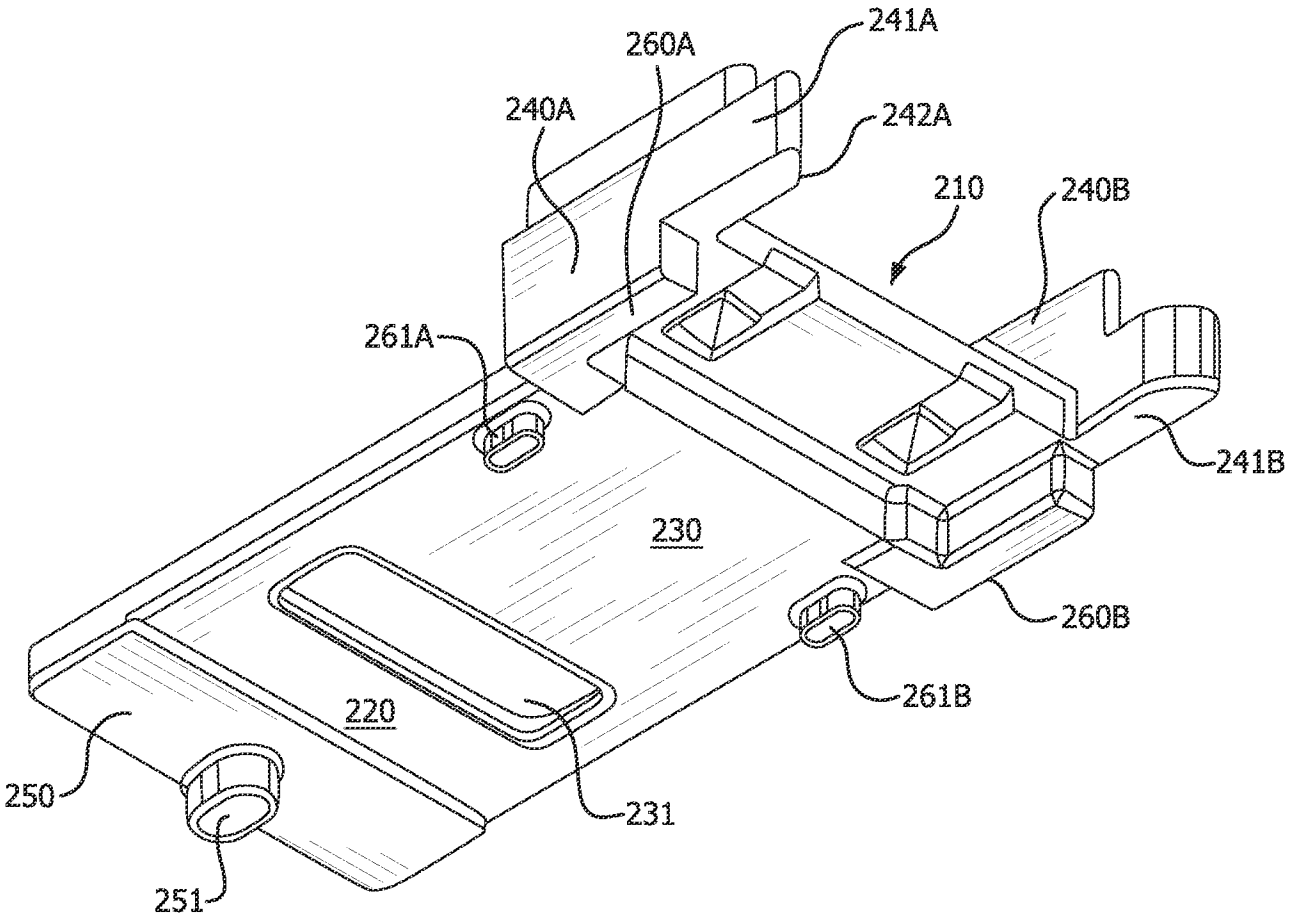
FIG. 6 is a bottom right perspective view of the neutral shutter of an exemplary embodiment of a TR receptacle according to the invention.

Turning to the specifics of the neutral slider 200. As best discerned from FIGS. 5 and 6, the neutral slider 200 includes a generally planar rectangular portion defined by a blocking portion 220 and central portion 230 which includes a hot blade opening 231. The central portion 230 terminates at the ramp portion 210 of the slider 200. The ramp portion 210 is flanked on each side by side fins 240A, 240B. The side fins 240A, 240B include finger extensions 241A, 241B defined by cut out areas 242A, 242B. The finger extensions 241A, 241B are topped with flanges 243A, 243B.

The underside of the neutral slider 200 includes a sliding pad 250 in the area of the blocking portion 220. The sliding pad 250 may include a sliding tab 251. The sliding tab 251 is sized to fit into a tab track channel 151 in the slider housing 100. The underside of the slider 200 in an area of the ramp portion 210 and side fins 240A, 240B includes slider pads 260 and may include slider tabs 261A, 261B that are sized to fit in tab track channel 161A, 161B provided in the slider housing 100. The frictional benefits of the slider pads and tabs will be readily appreciated and will be discussed in more detail below.

Figure 7:
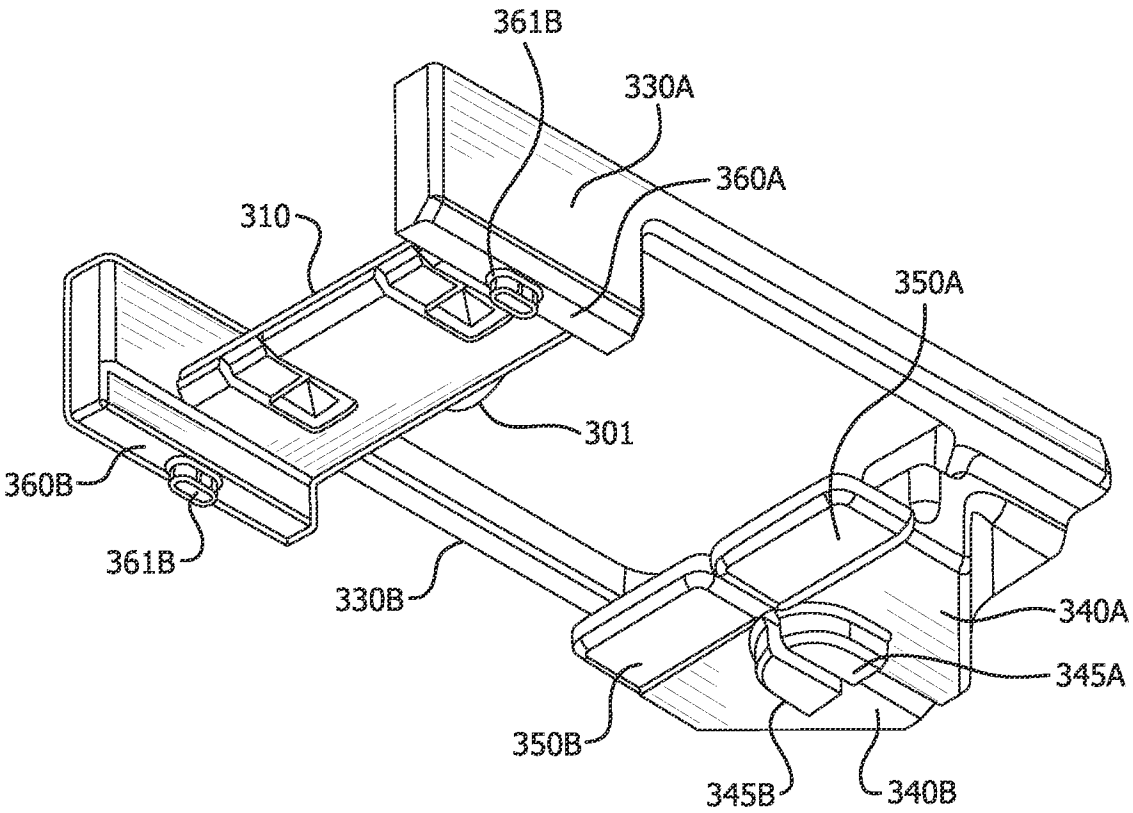
FIG. 7 is a bottom left perspective view of the hot shutter of an exemplary embodiment of a TR receptacle according to the invention.
Figure 8:
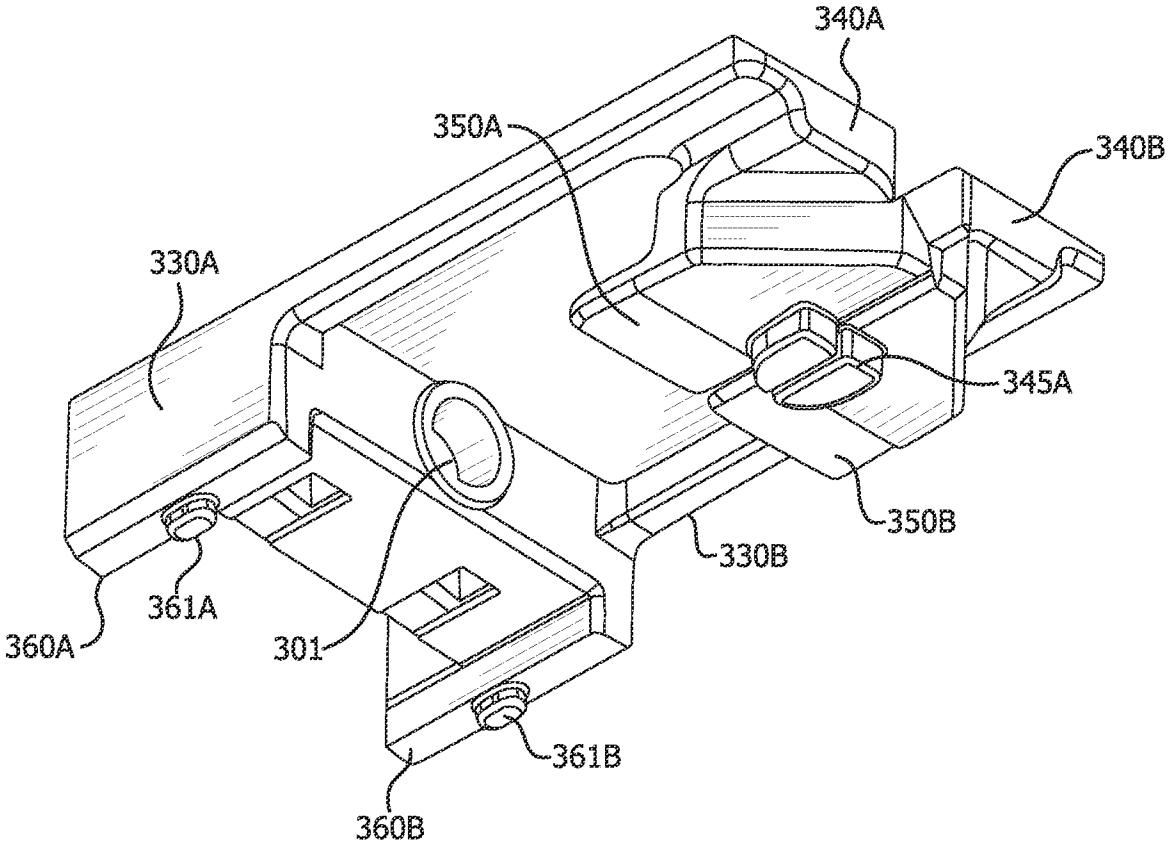
FIG. 8 is a bottom right perspective view of the hot shutter of an exemplary embodiment of a TR receptacle according to the invention

With respect to the hot slider 300, as best discerned from FIGS. 7 and 8, the hot slider 300 includes a ramp section 310 flanked by side fins 320A, 320B that include longitudinally extending right and left slider arm members 330A, 330B that terminate in right and left head portions 340A, 340B. The head portions 340A, 340B are separated from one another by a small gap. The slider arms 330A, 330B are flexible and designed to flex outwardly to allow the gap to spread. This allows the perpendicular blade of a 20 A plug to penetrate and pass through the gap during plug insertion.

The head portions 340A, 340B are prevented from being flexed open by the provision of respective halves of a raised guide 345A, 345B on the underside of the head portions. The guide 345 is sized to sit in, and be constrained by, the neck 121 of the neutral opening 120 of the housing 100 to maintain the gap in the closed. Only when the hot slider 300 is slid laterally does the guide 345 slide into the pentagonal area 122 of the neutral opening which provides enough room for the guide to be spread apart. This in turn means that the gap between the head portions 340A, 340B of the slider 300 can be spread to receive the perpendicular neutral blade of a 20 A plug. Thus, absent cooperative sliding of both sliders, the gap remains impenetrable by foreign objects. To this end, in a preferred embodiment, the terminal ends, or fingers 241A, 241B of the fins 240A, 240B of the neutral slider 200 extend into niches 390A, 390B in the head portions 340A, 340B and serve to hold the head portion gap closed unless the ramp 210 in engaged and the slider 200 laterally cammed away. Thus, only when both prongs of a plug blade are inserted into the receptacle can the gap be spread.

The underside of the hot slider 300 also includes slide pads 350A, 350B and tabs 351A, 351B disposed downwardly from the side fins 320A, 320B. The tabs 351A, 351B are sized to run in track channels 181A, 181B provided in the housing 100. The downward disposition of the fins and slide pads provides clearance for the blocking portion 220 of the neutral slider 200. Slide pads 360A, 360B are similarly disposed on the underside of the hot slider 300 in the area of the head portions 340A, 340B. The various slide pads (and tabs) serve to lessen the surface area of the sliders that rubs against the housing during plug insertion.

In this regard, the planar area comprising the blocking 220 and central portion 230 of the neutral slider 200 is narrower and disposed within the confines of the fins 340A, 340B and arms 330A, 330B of the hot slider 300. This configuration separates the hot and neutral sliders 200, 300 so they do not rub against each other during lateral movement. Similarly, the fins 240A, 240B of the neutral slider 200 are configured to provide safe passage of the hot slider 300 during movement to further minimize any friction between the surfaces.

As will be appreciated, in operation, each of the sliders 200, 300 is cooperatively configured to reduce or eliminate the points of contact between the two sliders when the ramps are engaged and the sliders lateral moved during the plugging process. Numerous configurations of the sliders may be envisioned to allow for operation of the cooperating sliders while reducing or eliminating the physical contact between the sliders.

One of ordinary skill will appreciate that the exact dimensions and materials are not critical to the invention and all suitable variations should be deemed to be within the scope of the invention if deemed suitable for carrying out the objects of the invention. In this regard, to combat the problem of plug blades gouging and deforming the ramp surfaces 210, 310 of the camming portions, the present inventors envision the provision of metal skins 500 on the ramp surfaces. The metal skins will resist scratching, gouging, and bending and hopefully extend the useful life of the product.

One of ordinary skill in the art will also readily appreciate that it is well within the ability of the ordinarily skilled artisan to modify one or more of the constituent parts for carrying out the various embodiments of the invention. Once armed with the present specification, routine experimentation is all that is needed to determine adjustments and modifications that will carry out the present invention.

The above embodiments are for illustrative purposes and are not intended to limit the scope of the invention or the adaptation of the features described herein to particular TR receptacles. Those skilled in the art will also appreciate that various adaptations and modifications of the above-described preferred embodiments can be configured without departing from the scope and spirit of the invention. Therefore, it is to be understood that, within the scope of the appended claims, the invention may be practiced other than as specifically described.

What is claimed is:

1. A slider assembly for a tamper resistant receptacle comprising:

a slider assembly including a slider housing, a neutral blade slide body, a hot blade slide body, and a central spring, said slider housing defining a hot plug blade opening and a neutral plug blade opening;

said slider housing configured as a unitary piece of plastic having a central planar portion surrounded by an ascending perimetrical sidewall of a height sufficient to house the slider assembly;

said neutral plug blade opening including a lateral neck portion and a pentagonal head portion, said neutral slider and hot slider disposed in the slider housing are spring biased in a closed position by a centrally disposed helical spring that extends between spring seats disposed on opposing lateral faces of said hot and neutral sliders, said lateral faces are on sides opposite each of a respective ramp portions of the sliders, said neutral slider ramp is contacted by the neutral blade of an electrical plug, and the hot slider ramp is contacted by the hot blade of an electrical plug said the neutral slider includes a generally planar rectangular portion defined by a blocking portion and central portion including a hot blade opening, wherein the central portion terminates at the ramp portion of the neutral slider, and said ramp portion is flanked on each side a side fin, said fins including finger extensions defined by cut out areas in said side fins.

2. The tamper resistant receptacle of claim 1, wherein said finger extensions are topped with flanges.

3. The tamper resistant receptacle of claim 2, wherein said neutral slider has an underside including a sliding pad in the area of the blocking portion.

4. The tamper resistant receptacle of claim 3, wherein the sliding pad includes a sliding tab.

5. The tamper resistant receptacle of claim 4, wherein the sliding tab is sized to fit into a tab track channel in the slider housing.

6. The tamper resistant receptacle of claim 5, wherein the underside of the neutral slider in an area of the ramp portion and side fins includes slider pads and slider tabs sized to fit in a tab track channel provided in the slider housing.

7. The tamper resistant receptacle of claim 2, wherein the hot slider includes a ramp section flanked by side fins that include longitudinally extending right and left slider arm members that terminate in right and left head portions.

8. The tamper resistant receptacle of claim 7, wherein the head portions are separated from one another by a small gap.

9. The tamper resistant receptacle of claim 8, wherein the slider arms are flexible and designed to flex outwardly to allow the gap to spread to allow a perpendicular blade of a 20 A plug to penetrate and pass through the gap during plug insertion.

10. The tamper resistant receptacle of claim 9, wherein the head portions are prevented from being flexed open by the provision of respective halves of a raised guide on the underside of the head portions, said raised guide being sized to sit in, and be constrained by, the neck of the neutral opening of the housing to maintain the gap in the closed position.

11. The tamper resistant receptacle of claim 9, wherein when said hot slider is slid laterally the guide slides into the pentagonal area of the neutral opening which provides enough room for the guide to be spread apart and the gap between the head portions of the slider can be spread to receive the perpendicular neutral blade of a 20 A plug.

12. The tamper resistant receptacle of claim 11, wherein absent cooperative sliding of both sliders, the gap remains impenetrable by foreign objects.

13. The tamper resistant receptacle of claim 12, wherein the fingers of the fins of the neutral slider extend into niches in the head portions and serve to hold the head portion gap closed unless the ramp in engaged and the slider laterally cammed away, whereby only when both prongs of the plug are inserted into the receptacle can the gap be spread.

14. The tamper resistant receptacle of claim 13, wherein the underside of the hot slider includes slide pads and slide tabs disposed downwardly from the side fins, wherein the tabs are sized to run in track channels provided in the housing.

* * * * *